US006463779B1

(12) United States Patent
Terziakin

(10) Patent No.: US 6,463,779 B1
(45) Date of Patent: Oct. 15, 2002

(54) INSTANT HEATING PROCESS WITH ELECTRIC CURRENT APPLICATION TO THE WORKPIECE FOR HIGH STRENGTH METAL FORMING

(76) Inventor: Mehmet Terziakin, Incircli C. Gulbahce S. 13/1 Bakirkoy, Istanbul, 34740 (TR)

( * ) Notice: Subject to any disclaimer, the term of this patent is extended or adjusted under 35 U.S.C. 154(b) by 0 days.

(21) Appl. No.: 09/720,161

(22) PCT Filed: Mar. 1, 2000

(86) PCT No.: PCT/TR00/00014

§ 371 (c)(1),
(2), (4) Date: Feb. 26, 2001

(87) PCT Pub. No.: WO00/74441

PCT Pub. Date: Dec. 7, 2000

(30) Foreign Application Priority Data

Jun. 1, 1999 (TR) ..... 1999/01215

(51) Int. Cl.[7] ..... B21D 37/16

(52) U.S. Cl. ..... 72/342.96; 72/342.94; 72/350; 72/364; 72/379.2; 148/567

(58) Field of Search ..... 72/342.1, 342.94, 72/342.96, 709, 342.92, 347, 350, 364, 379.2; 148/691, 692, 566, 567; 219/645

(56) References Cited

U.S. PATENT DOCUMENTS 3,933,020 A * 1/1976 Orr et al. ..... 72/297
4,532,793 A * 8/1985 Bezold ..... 72/342.1
5,277,045 A * 1/1994 Mahoney et al. ..... 72/709
5,515,705 A * 5/1996 Weldon et al. ..... 72/342.96
5,737,954 A * 4/1998 Yasui ..... 72/342.96
5,744,773 A * 4/1998 Van Otteren et al. .... 72/342.96
6,033,499 A * 3/2000 Mitra ..... 72/342.1
6,384,388 B1 * 5/2002 Anderson et al. ..... 219/602

FOREIGN PATENT DOCUMENTS

JP 57-202919 * 12/1982 ..... 72/342.1
JP 59-206118 * 11/1984 ..... 72/342.94
JP 6-297049 * 10/1994 ..... 72/342.1

* cited by examiner

*Primary Examiner*—Ed Tolan

(57) ABSTRACT

A process and relevant tools for hot forming of high strength metal workpieces by means of applicating high density current to the workpiece directly and generating heat inside it by using its own electrical resistance in order to obtain desired temperature and formability at the desired moment of the forming process without requiring any external heat source or previous heating process. Temperature of the blank is measured by measuring its electrical resistance and by using linear correlation between temperature and resistance. This heating process can be applicated in several metal forming types such as high strength sheet stamping (FIG. 2, FIG. 3), bending (FIG. 3), blow forming (FIG. 4, FIG. 5) in accordance with mechanical operations of the relevant processes. High temperature rates can easily be reached and kept at the desired moment of the forming process without being effected by rapid cooling phenomena resulted by too much heat loss area/mass and heat storage capasitance of thin sheets. Ceramic tools and dies are available in these process offering electrical nonconductivity, thermal low conductivity and durability against heat. Cooling process of the formed workpiece between dies under pressure provides dimentional accuracy and increased yield strength resulted by regular elongation effect and rapid temperature decrease.

11 Claims, 4 Drawing Sheets

INSTANT HEATING PROCESS WITH ELECTRIC CURRENT APPLICATION TO THE WORKPIECE FOR HIGH STRENGTH METAL FORMING

FIELD OF THE INVENTON

This invention relates to a hot stamping process and apparatus for forming sheet metal alloys with low formability at room temperature. In particular, this invention relates to a warm/hot sheet forming operation with rapid preheating process on the press table by direct electric current application to the workpiece using two electrode sets contacting at two opposite edges of the workpiece.

BACKGROUND OF THE INVENTION

In the plastic forming processes of various metal parts, heating is sometimes necessary before a forming operation. In the metal deformation processes such as forging, extrusion, rolling etc. the workpiece is heated above its recrystallization temperature prior to subsequent forming operation and these processes are generally referred as hot working.

In common hot forming techniques, the metal workpiece is heated in a fuel-fired or electric furnace before mechanical forming operation performed by forging, rolling, extrusion, drawing etc. During the period in which the workpiece is removed from the furnace and placed on the press table between the dies, a considerable amount of heat is lost from the workpiece. Generally, heat loss is proportional to surface area of the workplece. Heat is held by the mass of the original workpiece and heat loss occurs in peripheral area of the workpiece by radiant, convective and conductive means. Increase in peripheral area/mass ratio of the metal workpieces results in more rapid cooling phenomena during handling from furnace to forming machi ne, and thus, hot forming of such thin metal workpieces become difficult or practically impossible in some cases. Radiant heat loss becomes dominant at high temperatures, because it is proportional to fourth power of the workpiece temperature, and while conductive heat loss is linearly proportional to temperature of the workpiece.

Hot forging including preheating at a furnace, handling to forming machine and then compression forming is a widely used hot working process for a long time all around the world. In such a process heat loss of the hot bulk workpiece can be kept in an acceptable level and does not prevent the operation.

In hot working of a sheet metal workpiece with thickness between 0.6 and 3 mm such as articles used in automotive industry, peripheral area/mass ratio is too much and such a workpiece cannot keep its temperature sufficiently during handling of hot blank to be placed between dies after furnace heating. A hot blank sheet loses a considerable amount of heat and its temperature rapidly decreases below hot working temperature range within a few seconds. Most of high strength alloy steels, aluminum and magnesium alloys are temperature sensitive and they are only formable within narrow ranges of temperature. Such a heat loss becomes particularly severe for high strength and thin alloy sheets, and thus, subsequent hot working becomes practically impossible. Therefore, there is not a widely used hot stamping method in use for production articles made from high strength alloy sheet for particularly automotive industry.

In practice, such a thin sheet can keep its temperature only a few seconds for subsequent forming process. For example, in a steel blank sheet in 1100° C. temperature with 1 mm thickness, temperature decrease rate is more than 100° C./sec. Heating the workpiece to higher temperatures is not a solution, because radiant heat loss varies with fourth power of the temperature and temperature fall becomes more severe. On the other hand, overheating may alter microstructure (grain size, structure, elongation rate, formability, strength etc.) of the workpiece or cause surface oxidation.

Although there are much higher strength steel and aluminum alloys, currently used stamping technology can not form such metal thin sheets by currently used sheet stamping technology due to lack of formability. Thin sheets made of such alloys can offer very higher strength up to three or four times more strength than of currently used sheets in automotive production. Such metal blanks principally can only have adequate formability in high temperature rates and within tight range.

The most important utilization area of the invention is the automotive industry. One of the main challenges for the today's automotive industry is "How to produce lightweight and stiff auto chassis and body construction in mass production with high quality low cost". Stamped sheet articles consist of (app. % 50 –60) most of auto body weight. There are many weight loss programs carried out by car companies, suppliers etc all around the world in efforts to make new production technologies more responsive to needs of the low fuel consuming vehicles of tomorrow. There are many technical teams in the automotive world, in collaboration with the national labs, universities and suppliers, are working to reduce vehicle weight as compared to today's compact and midsize family sedans. Therefore, there is a widespread tendency to use widespread tendency to use relatively higher strength steels and light aluminum and magnesium alloys in the automotive industry.

From aspect of safety, energy rate that can be absorbed elastically during a crash by a metal auto part until plastic deformation limit is proportional to second force of its yield strength. However, a single part made of relatively higher strength metal might require more stamping stages than a comparable part or the part may have to divide into two or more pieces that are then joined together. Nevertheless, these solutions add time and cost to the manufacturing process. Thus, engineers have been trying to find other methods to replace or complement the conventional mechanical stamping process in order to fully realize the potential weight savings of using of higher strength steel and aluminum components. On the other hand, such materials cause more wrinkles and tears during manufacture and require significant try-out modification and completion works for dies and tools requiring higher cost, time and labor.

SUMMARY OF THE INVENTION

The main principle of the invention is to achieve both direct heating of the blank by current application on the press table and hot stamping operation performed as subsequent process achieved in one place (press table) without requiring any handling operation of the workpiece resulting severe temperature fall preventing such an hot shaping process. Temperature fall at the hot thin sheet during handling from pre-heating furnace to press table is so severe that it is practically impossible to keep its heat sufficiently until end of the stamping process between two dies.

For example, steel sheet thickness, 1 mm , T=1100° C., Temperature decrease rate =110° C./sec Heat Energy Equation of this process:

$$R(1+{}^{*}\alpha^{*}\Delta T)I^{2} = \underbrace{[m^{*}c^{*}dT/dt]}_{\text{Heat rate held mass of the workpiece}} + \{2^{*}A^{*}4.96^{*}k^{*}[(T_s/100)^4 - (T_e/100)^4\}_{\text{Heat loss by radiation}} + \underbrace{A^{*}\beta^{*}\Delta T}_{\text{Heat loss by Convection}}$$

where R electric resistance of the workpiece (Cold), α Resistance increase coefficient by temperature, ΔT temperature increase of the sheet, I current, m mass of the workpiece, C Specific thermal capacitance, A Area (one side) of the WP, $T_s$ temp of the sheet, $T_e$ peripheral temperature, β Convection coefficient, k radiant heat transfer coefficient.

The process ensures instant temperature rate of the hot sheet at the stamping moment by controlling principal parameters of the process such as, current, current application time, stamping time etc within one machine. This process can be applied in mass production of articles made from high strength alloy sheets for automotive industry, because whole process including, heating, stamping, cooling within dies is performed in one machine within a few seconds. It's very important to prevent thermal or mechanic distortions of formed article during cooling after hot stamping. Cooling must be performed without any distortion and preferably; formed sheet should be removed from the dies after sufficient temperature fall. Dimensional stability and sufficient strength (after cooling) should be ensured during removing of the stamped part. Particularly, automotive industry demands strict dimensional tolerances. This process achieves instant cooling of the workpiece without distortion by means of cooling under pressure of cold dies. The dies are kept within a previously determined temperature range that is fairly lower than forming temperature of the workpiece. A little amount of heat is gained by dies by contact of the hot workpiece at each process cycle. On the other hand, the dies continuously lose heat because their temperature will be slightly higher than room temperature during mass production.

The process starts with current application to the workpiece for a few seconds and temperature of the blank sheet is reached previously determined rate to provide sufficient formability characteristics in the workpiece such as elongation rate, yield strength etc. Until this certain temperature rate is provided in the workpiece, the dies are not in contact with hot workpiece. At least one die is moved toward the hot sheet and sheet is stamped. Temperature of the dies is fairly lower than hot forming temperature and slightly higher than room temnperature. An instant cooling process is achieved at the end of the stamping while the sheet is being completely compressed with two dies and it is very important to prevent thermal or mechanical distortions in order to provide strict dimensional tolerances.

Similar heating process is also needed in sheet bending and prototype production processes if the blank sheet is made from high strength alloy metal. In bending process of such blanks, similar heating operation is applied before bending. In prototype production with use of one die, the main principle of the invention is applied and these processes are explained below.

BRIEF DESCRIPTION OF SEVERAL VIEWS OF DRAWING

Four figures were prepared to explain the main process and relevant production tools and details.

Figure 4:
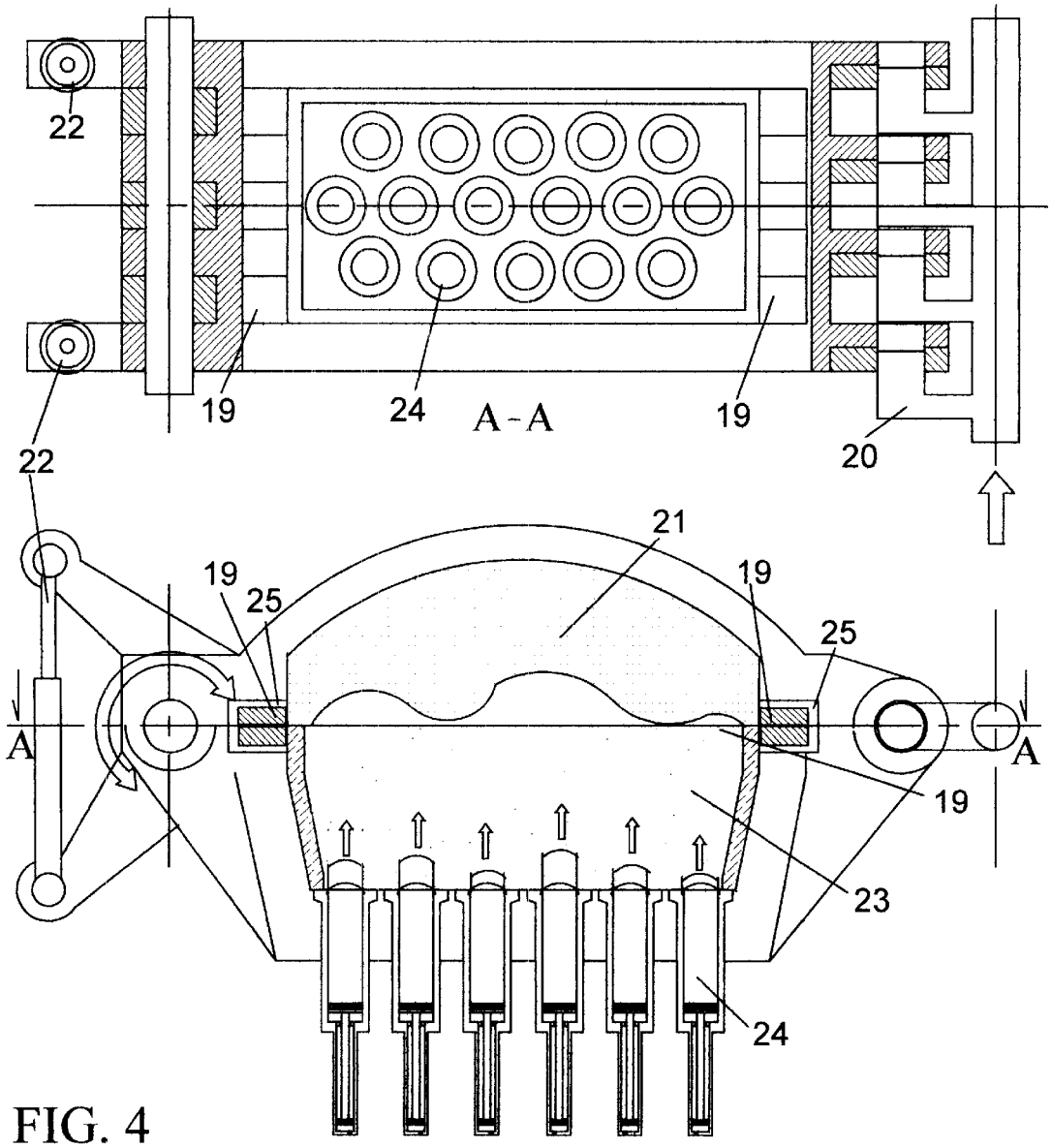

FIG. 4 indicates application of basic process in a press cell type using one die and compression of solid mixture. FIG. 4 is also comprises of plan (upper side) and sectional (lower side) views of relevant press cell.

DETAILED DESCRIPTION OF THE INVENTION

Figure 1:
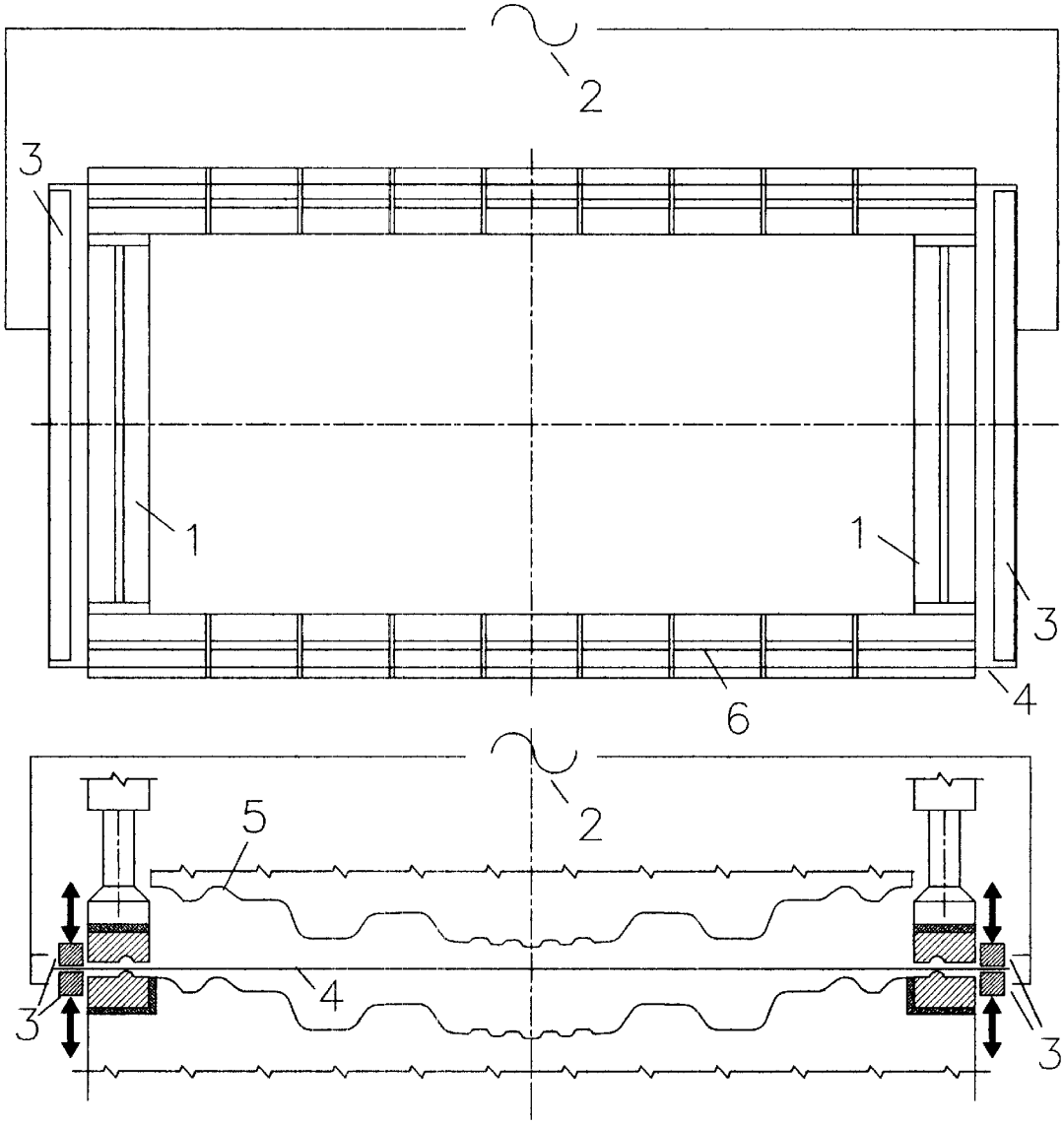
FIG. 1 shows application of the main principle in high strength sheet stamping process and consists of a plan view (upper side) and a cross sectional view (lower side) of the press table of regarding with this invention.

The main principle of the invention as shown in FIG. 1 is to apply high electric current density passing entirely blank 4 from one side to opposite side by using electrodes 3 contacting with two opposite sides of the blank 4 at the press table therefore both instant heating and stamping processes are performed in one machine. This process and relevant apparatus ensure hot stamping process of the sheet at a previously determined temperature and thus, suitable elongation and yield strength rates. This process eliminates carrying time between preheating and stamping processes.

Actual temperature of the hot blank can be controlled preciously by measuring electrical resistance change of the workpiece from beginning of heating by using linear correlation between temperature and electrical resistance. The heating system is controlled by a control device measng electrical resistance and calculating actual temperature, therefore control device determines acting moment of the of the forming mechanism. In mass production if proper characteristics of above process are determined by adequate research and experiences, whole process can be carried out with previously determined parameters without using a feedback control system. "Hot forming" term as used in this description includes suitable temperature ranges providing increase in elongation rate and formability and decrease in yield strength rates for various metal types and these temperature ranges for various metal alloys can be above or below metal recrystallization temperature of these metals.

As seen in FIG. 1 Electrodes 3 are placed two opposite sides of the press table. At first, blank 4 is placed on the press table. Electrodes 3 are contacted with the blank 4 and applies high density current along the blank. An external current source 2 provides low voltage current with high current rates and two end of the current source are connected to two electrodes 3 placed two opposite edges of the blank sheet. During heating process, the blank holders 1, 6 do not hold the blank and allows its regular thermal expansion laterally in order to avoid wrinkles. The blank holders 1, 6 are made from nonconductive materials in order to avoid short circuit during direct current application to the blank sheet. The contact pressure of the electrodes 3 is properly determined to allow expansion of the blank 4 during heating by means of controlled sliding movement between workpiece and electrodes. On the other hand both two electrode groups 3 are slightly pulled back (with an hydraulic system etc.) during heating in the longitudinal direction in according to thermal expansion with the aim of keep flat blank surface.

Figure 2:
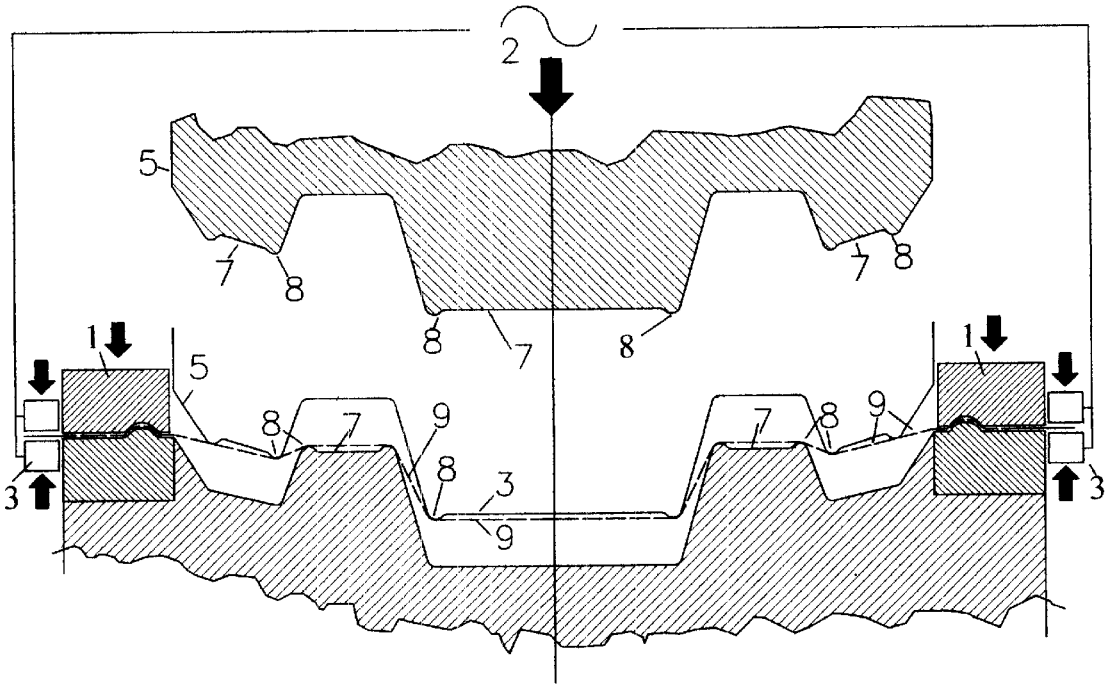
FIG. 2 is a sectional view of the press table and includes some additional details about stamping stages.

Thus, the workpiece instantly (within a few seconds) reaches high temperature degrees (app. 800–1000° C. for steel and 350–500° C. for aluminum alloys). Then the binders hold the hot blank and upper die 5 is moved down and hot workpiece is formed. Above system ensures workpiece temperature until contact moment of the die and workpiece. Due to forming speed of the die 5 (from first contact moment to the blank to contact moment to other die) of the (esp. Mechanical) presses is sufficiently high and most of workpiece area (As Shown in FIG. 2, as indicated by dashed lines 9) (esp. areas involving high local elongation rates) do not in contact directly with the cold die surface until end of the forming process, the workpiece sufficiently keeps its high temperature within fast stamping process. Blank holder surfaces 6 can be made of ceramic insert parts in order to isolate heat and current to avoid heat loss from workpiece to press table. Because of the rapid heating, heat loss from the blank will be fairly low thereby electric energy will be consumed efficiently to heat workpiece directly.

If relatively slow hydraulic presses are used in such a process some adjustments in die form can be made (FIG. 2) to reduce contact area between hot blank and cold die surface during forming (especially in chassis and frame production including flat surfaces and rounded edges) in order to reduce heat loss until end of the process.

As shown in FIG. 2 downward facing surfaces 7 of the upper die and facing surfaces of the lower die are designed as concave 7 forms surrounded by rounded extensions 8. As indicated in FIG. 2 by dashed lines 9 most of the workpicce area is not in contact with the die surface 5, 7 until end of the process. Since press force acting die surfaces will be significantly lower in such a process than that of conventional stamping due to forming in high temperature rates of the blank, "Fragile" ceramic dies can be used conveniently. In such a case high density current can also be applied during forming stage due to electrical no conductivity of the material of the dies and the binders. Additionally ceramic is resistant against heat. Heat storage capacity of a thin metal blank is low even though it is heated to the high temperatures. It enables to control temperature of the workpiece until end of the process. On the other hand, the workpiece cools more slowly (than of hot stamping with metal tools) after forming resulted by low thermal conductivity of the ceramic materials. This process can be applied in one stamping stage or can be divided into multi hot stamping stages and additional heating-annealing processes can be achieved depending of part geometry complexity and metal features between forming stages.

This process causes considerable increase in yield strength of the finished parts because of two reasons. First reason is rapid cooling between two dies. The second one is regular elongation effect (app. % 1–1.5) involved through whole workpiece area. These issues will be explained below. As it know both rapid cooling and rapid deformation (work hardening) lead to increase in yield strength especially in steels including sufficient carbon or some other suitable alloys. If the blank is formed by this process in a hydraulic press, at the end of the forming stage hot workpiece cools instantly between two dies. In high strength alloy sheets, instant cooling leads to significant increase in yield strength. During cooling stage, formed workpiece is stretched due to rapid temperature decrease and shrinking. While hot workpiece is cooled between upper and lower dies under pressure, any considerable change in dimensions can not occurs in spite of rapid cooling. It means that a regular elongation effect occurs in whole area. Total elongation rate in unit area is sum of plastic and elastic elongation rates. After workpiece is ejected from the dies, the formed part shrinks elastically by ratio of actual yield strength/Elasticity modulus. At the die designing stage, this shrinkage ratio should be considered. Deviations in dimensions of the finished parts essentially depend on deviations of yield strength rates of the finished parts. Because stamped sheet cools between dies without any practical changes in dimensions and elastic shrinkage factor can be calculated and considered previously, this process is precious, dependable and reproducible.

If this process is performed in a mechanical press formed workpiece can be ejected from lower die by an automatic mechanism while upper die is moving up after stamping. In contrast to cooling between dies, in this case formed workpiece cools and shrinks in air freely. Shrinkage ratio will be higher than above process but it is possible to control cooling and shrinkage characteristics by means of changing press speed, workpiece temperature and ejecting mechanism speed. In this process, heating and forming systems should be controlled and operated in accordance by the same control device. Because of the rapid heating, heat loss from the blank will be fairly low thereby electric energy will be consumed efficiently to heat workpiece directly.

Figure 3:
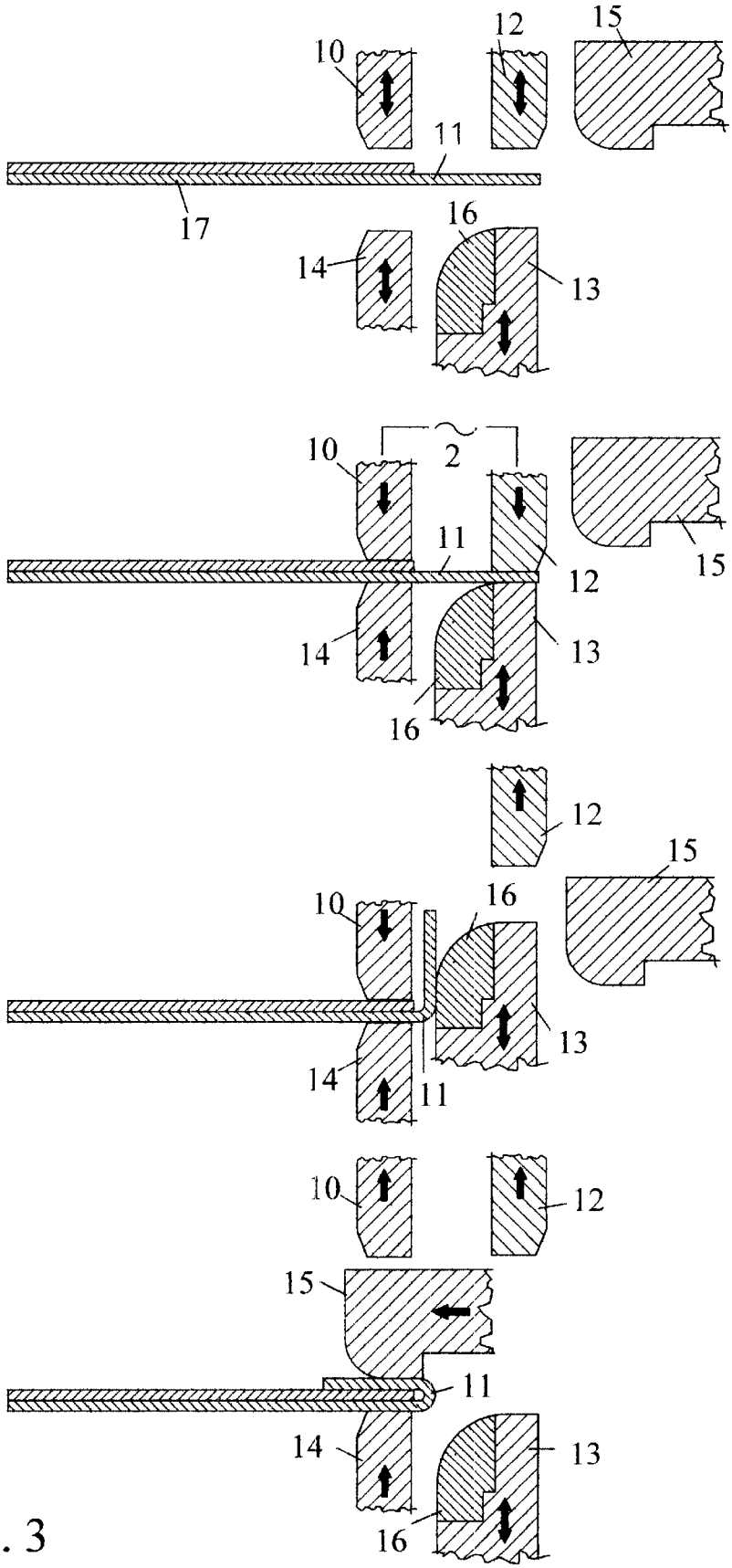
FIG. 3 is prepared with the aim of explain how the basic process can be applied in bending of the high strength metal workpieces and includes relevant forming stages in sequence and relevant tools.

The invention can also be used in bending (FIG. 3) of high strength alloy sheets featuring very low formability. In such an application, only a long and narrow bending line 11 is heated by a set 10,12 of electrodes placed two sides of the bending line. A set of apparatus as seen in FIG. 3 are used for instant heating with current and bending of the workpiece. These tools 10, 12, 13, 14, 15 are moved in sequence by pneumatic or hydraulic etc. system in accordance with instant heating process. At first, electrodes 10 and 12 are pushed onto the workpiece 17 and apply high-density current to be conducted by bending are soon as sufficient temperature obtained at the bending line 11, electrode 12 is moved up and then first bending tool 13 is moved up and down thus workpiece is bended by about 90 degrees. A portion 16 of the electrode 13 can be made as a ceramic insert with the aim of reducing heat transfer between hot area 11 and tool 13. At this moment, Part 15 is moved ahead thereby the blank is bended by 180 degrees.

If bending of the workpiece will be achieved along a curved (e.g. body or door panel for automotive industry) line 11 tools of this process should be designed in accordance with curved bending line. Similar well-known technologies about bending and resistance welding simplify to achieve above process.

This invention can be applied in (FIG. 4) "Hot stretch sheet forming with pressure of sand/lubricant mixture". To product low volume and high strength panels and frames this technology will be an attractive alternative with low tooling cost due to requiring only one die (made of ceramic or concrete) and not requiring long design time and cost. The die 21 is placed inside the cover of the press cell. Hydraulic pistons 22 are used for opening or closing upper side side of the press cell. The blank is placed on the lower housing and situated between two opposing electrode sets 19 and edges of the blank are in contact with electrodes. Part 20 is used for locking of upper side of the press cell. As seen at FIG. 4 in this process the hot blank is heated directly by electric current application and predetermined temperature is reached at the blank sheet Sand and lubricant mixture 23 is pushed up by hydraulic cylinders 24 placed bottom of the mixture bowl and therefor heated blank flows smoothly into the die 21 under pressure of the sand &. lubricant mixture 23. In this process, solid mixture 23 is in contact directly (without any flexible membrane) with the hot blank. The main principle of the invention "Instant Heat generation in the workpiece by applying high current rate" is achieved in a similar way like above processes. Two opposite sides of the blank-holders include electrodes 19 and other parts are made of ceramic inserts. Electrodes 19 are electrically isolated from whole mechanic apparatus by isolation member 25 . Due to thermal conductivity of the sand mixture 23 is very lower than that of metals, heat can be generated by current along the forming process while the hot blank 19 is bulging into the die 21. Sand mixture 23 (or any other proper solid material Aluminum Oxide etc.) is very durable against heat and features very low thermal conductivity. Therefore, heat generated in the workpiece will not be absorbed instantly by the sand. If the die is made of ceramic or concrete, heat loss of the workpiece became moderate after contact moment between hot sheet and the die.

While the invention has been described in terms of a few specific embodiments thereof, many changes and other applications of the invention will became apparent to those skilled in the art after considering the specification together with the accompanying drawings.

I claim:

1. A process for forming sheet metal workpieces before which at least two electrode sets placed on two opposite edges of said sheet that is electrically isolated from whole mechanical forming apparatus including dies which are situated at two opposite sides of said blank sheet, the process including;

placing the said sheet metal workpiece as a blank on the press table;

contacting said metal workpiece with at least two electrode sets placed at two opposite edges of said blank sheet;

application of current to the workpiece directly with electrode sets fed by an external current source;

generating heat inside the sheet metal workpiece to reach a certain forming temperature;

stopping current application to the workpiece;

keeping the heated blank stretched by clamping peripheral edges of said blank by a blank holder;

stamping said heated blank sheet by actuating at least one die of the press toward; said workpiece;

pulling back at least one die from the formed workpiece;

removing the formed sheet workpiece from the at least one die.

2. The process as defined in claim 1, further comprising a rapid cooling process for stamped sheet including;

keeping temperature of the dies within a predetermined temperature range under forming temperature of the workpiece by allowing heat loss from the dies during production cycles;

avoiding material shrinkage during cooling of the stamped workpiece by means of holding the sheet between two dies at the end of the stamping process until a previously determined temperature at the workpiece is reached within a certain period;

providing increase in yield strength of the said sheet material by means of cooling.

3. The process as defined in claim 1 wherein at least one die includes at least one sheet forming surface having a depression at the inner region of said forming surface comprising extentions at the periphery of said depression to prevent contact between inner concave region of said forming surface and facing stretched hot sheet during stretching process for avoiding instant temperature fall at the hot sheet surface to keep formability said region of engaged hot sheet.

4. The process as defined in claim 1 wherein at least one die is constructed from ceramic material.

5. The process as defined in claim 1 wherein said blank holder includes at least one ceramic insert contacting with the workpiece.

6. The process as defined in claim 1 further comprising a control process with use of a feedback control device, said control process including:

measuring voltage and current rates of the current application to the workpiece along the heating process of said blank sheet workpiece by direct current application;

calculating instantaneous electric resistance by using instantaneous voltage and current rates of the current being conducted across the workpiece;

calculating instantaneous temperature rate of the workpiece by using linear correlation between electric resistance and temperature;

adjusting the current rate applied to the workpiece;

determining a proper actuating instant of at least one die toward said hot blank;

activating said die toward said hot blank;

controlling a cooling process of stamped blank between two dies by means of calculating a instantaneous temperature rate of the workpiece while the blank is being held between two dies;

determining a proper instant for removing a stamped sheet by means of moving back of at least one die;

activating said die back from the stamped sheet;

removing said formed sheet removed from the at least one die.

7. The process as defined in claim 1 further comprising a control process with a time relay controlling both electric current application and stamping process in accordance with a certain time reference data for each process cycle, including;

starting direct electric application to the workpiece;

heating said workpiece by direct electric application within a predetermined period;

clamping a hot blank by actuating a blank holder for a predetermined period from the beginning;

stamping the hot sheet by actuating at least one die upon the workpiece in a predetermined period;

holding said stamped sheet between two dies for a predetermined period;

moving back at least one die from the workpiece at a predetermined time from the beginning.

8. The process as defined in claim 1, further comprising convective heat loss compensation and conductive heat exchange reducing means between hot blank sheet and the dies after at least one die contacts with said hot blank by employing ceramic dies including;

continiuing current application to the workpiece after contact occurs between at least one die and said hot sheet by avoiding a short circuit between said sheet and at least one die by employing dies made of nonconductive ceramic material;

reducing conductive heat exchange between said dies and said hot sheet during stamping process by employing dies made of ceramic material.

9. The process as defined in claim 1, further comprising providing short circuit preventing means between the blank holders and said workpiece during resistance heating while said workpiece is being held by the blank holders by means of using nonconductive ceramic coatings on the contacting surfaces of the blank holders.

10. A process for hot bending sheet metal workpieces performed between at least two electrode sets placed on two opposite sides of a bending line of the blank sheet with a certain spacing among said electrodes, the process including:

placing the said blank into bending apparatus;

contacting at least two electrode sets on two opposite sides of the bending line of said sheet metal blank with a certain spacing among said electrodes as wide as a heating area width;

starting to apply electric current to be connected across width of the bending line of said sheet workpiece via two electrode sets fed by an external current source;

heating along said bending line with a certain width determined by said spacing among the two electrode sets by current application at a certain rate for a certain time to reach a previously determined bending temperature:

holding the blank sheet on one side of the bending line;

bending the other side of said sheet along the hot bending line by pushing with a die set on the other side of the sheet.

11. An apparatus for hot forming process for sheet metal workpieces pre-heated by direct electric curret application between at least two electrode sets placed on two opposite edges of said sheet, the apparatus including:

upper and lower metallic housings;

said blank sheet placed between said upper and lower housings;

at least two electrodes situated at two opposite edges of said blank sheet to apply current to said blank to generate heat wherein;

an external current source including two connector ends is connected to the two said electrodes;

an electrical isolation between whole mechanical apparatus and current passage including electrodes and said blank, an upper forming die contained within the upper housing above said sheet workpiece;

a lower housing containing sand lubricant mixture filled below said sheet workpiece to connect any internal pressure toward said blank sheet;

at least one hydraulic piston mounted below said lower housing to generate internal pressure inside said lower housing and fed by an external hydraulic pump;

at least one movable piston rod mounted to said hydraulic piston inserted into said sand lubricant mixture to push said sand lubricant mixture against said blank sheet to be stretched into an upper die cavity and to be formed by the die surface;

a control device controlling both heat generation inside said blank sheet by starting and stopping current application to said workpiece and controlling movement of said at least one hydraulic piston generating internal pressure to form said heated blank sheet by pushing said blank into the die cavity in synchronization.

* * * * *